United States Patent [19]

Flaherty

[11] Patent Number: 4,459,507

[45] Date of Patent: Jul. 10, 1984

[54] FLUORESCENT LAMPS HAVING IMPROVED MAINTENANCE AND METHOD OF MAKING SAME

[75] Inventor: John M. Flaherty, Peabody, Mass.

[73] Assignee: GTE Products Corporation, Stamford, Conn.

[21] Appl. No.: 349,723

[22] Filed: Feb. 18, 1982

[51] Int. Cl.[3] ..... H01J 61/35

[52] U.S. Cl. ..... 313/489; 313/486; 313/485

[58] Field of Search ..... 313/489, 486, 485

[56] References Cited

U.S. PATENT DOCUMENTS

| | | | |
|---|---|---|---|
| 2,386,277 | 10/1945 | Smith | 313/489 X |
| 4,020,385 | 4/1977 | Lagos | 313/489 |
| 4,289,991 | 9/1981 | Schreurs | 313/489 |
| 4,396,863 | 8/1983 | Ranby et al. | 313/486 |

FOREIGN PATENT DOCUMENTS

| | | | |
|---|---|---|---|
| 53-23175 | 3/1978 | Japan | 313/486 |
| 54-154176 | 12/1979 | Japan | 313/489 |
| 56-114273 | 9/1981 | Japan | 313/486 |

*Primary Examiner*—David K. Moore
*Assistant Examiner*—Vincent De Luca
*Attorney, Agent, or Firm*—William H. McNeill

[57] ABSTRACT

Lumen maintenance of fluorescent lamps is improved by applying over the phosphor of the lamps a vapor deposited film of yttrium oxide having a purity of 99.99%. The vapor is generated by electron beam bombardment of an yttrium oxide target and the film is most efficacious when applied to a thickness of from about 120 to about 600 angstroms.

8 Claims, 7 Drawing Figures

FLUORESCENT LAMPS HAVING IMPROVED MAINTENANCE AND METHOD OF MAKING SAME

TECHNICAL FIELD

This invention relates to fluorescent lamps and more particularly to such lamps having improved maintenance and to methods for making the lamps.

BACKGROUND ART

Fluorescent lamps are well known light sources famous for their high light output and relatively long life. Such lamps comprise a tubular, hermetically sealed, glass envelope having electrodes sealed in the ends thereof. An arc generating and sustaining medium, usually at low pressure, and comprising one or more inert gases such as argon, krypton, etc., or mixtures thereof, together with a small amount of mercury, is present in the envelope. The interior of the envelope is coated with a layer of phosphor which will absorb various forms of energy generated by the arc (usually wavelengths of ultraviolet) and retransmit this energy in the form of visible light.

These lamps, as well as all other known lamps, suffer from a gradual decrease in light output as they age. The light output of a lamp at any time is given as a fraction or a percentage of the original output and is called the maintenance at that time. Maintenance can be measured in lumens or other arbitrary units. Poor maintenance has been a major factor preventing the successful application of many phosphors.

The conditions that cause the loss in light output are many and include the initial processing conditions where the lamp is baked to temperatures of 600° C. which can cause serious degradation in the performance of some phosphors.

After completion of the lamp, during operation thereof, the phosphor is subjected to the mercury vapor discharge where it is exposed to high energy ultraviolet radiation as well as being bombarded by ions, electrons and atoms. These factors, among others not well understood, contribute to the loss of brightness in fluorescent lamps.

A number of techniques have been suggested to overcome or at least retard the decrease in loss of light output. These techniques have included better processing of the phosphors, and methods to shield the phosphors from the deleterious effects of the lamp processing and arc discharge by the application of a protective film over the phosphor. Various materials for this shielding have included silica and alumina.

While all of the above techniques have provided some improvement, it would be an advance in the art to further improve the maintenance of fluorescent lamps.

DISCLOSURE OF THE INVENTION

It is, therefore, an object of the invention to obviate the disadvantages of the prior art.

It is another object of the invention to improve the maintenance of fluorescent lamps.

It is still another object of the invention to provide a method for accomplishing these desirable objects, which method is fast and economical.

These objects are accomplished, in one aspect of the invention, by the provision, within a fluorescent lamp, of a maintenance improving coating of yttrium oxide which overlies the phosphor.

The coating is applied to the phosphor by depositing thereon an yttrium oxide vapor which has been generated by electron beam bombardment of an yttrium oxide target.

and

FIGS. 3–7 show graphically the improvement achieved by utilization of the invention.

BEST MODE FOR CARRYING OUT THE INVENTION

For a better understanding of the present invention, together with other and further objects, advantages and capabilities thereof, reference is made to the following disclosure and appended claims taken in conjunction with the above-described drawings.

Figure 1:
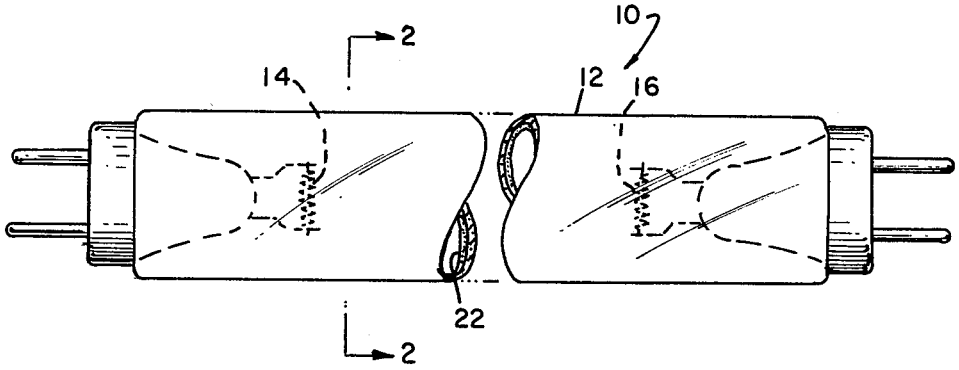
FIG. 1 is a diagrammatic elevational view of a lamp.
Figure 2:
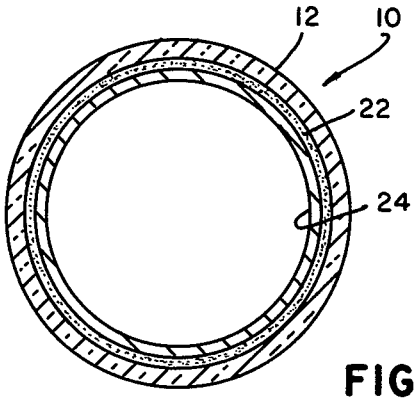
FIG. 2 is a sectional view taken along the line 2—2 of FIG. 1.

Referring now to the drawings with greater particularly, there is shown in FIG. 1 a fluorescent lamp 10 comprising a tubular, hermetically sealed, glass envelope 12. Electrodes 14 and 16 are sealed in the ends of envelope 12. Suitable terminals 18 and 20 are connected to the electrodes 14 and 16 and project from envelope 12. An arc generating and sustaining medium such as one or more inert gases and mercury vapor is included within envelope 12.

A layer of phosphor 22 is applied to the inside surface of envelope 12. While phosphor 22 can be any material useful in fluorescent lamps, the invention herein described is particularly efficacious when the phosphor is manganese activated zinc orthosilicate ($Zn_2SiO_4$:Mn). This phosphor is much employed because of its green emission under the ultraviolet radiation generated within a fluorescent lamp. It is also notorious for its poor maintenance.

To rectify the above problem, a maintenance improving coating 24 of yttrium oxide ($Y_2O_3$) is applied over phosphor 22. the yttrium oxide is of substantial purity; i.e., of the order of 99.99% pure and is deposited upon the phosphor 22 from a vapor generated by electron beam bombardment of an yttrium oxide target. The coating 24 can be applied to the phosphor 22 after it has been coated on envelope 12, in which case it provides a layer over the phosphor layer; or it can be applied to the phosphor particles themselves before they are applied to the envelope. In the latter case, the yttria layer substantially surrounds the phosphor particles.

Figure 3:
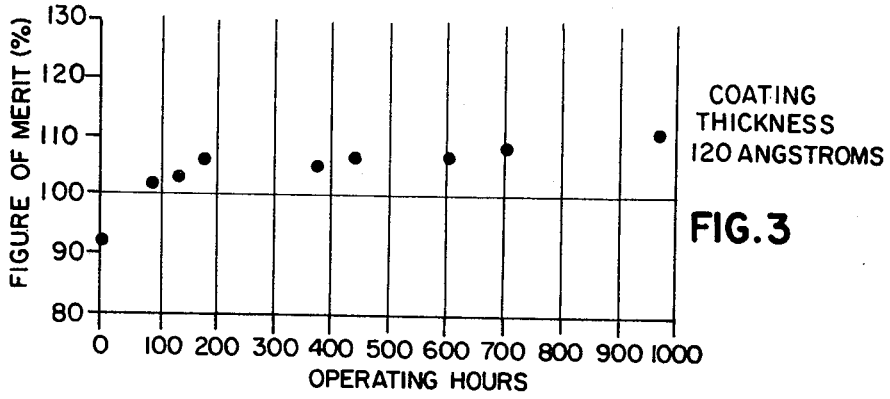
Figure 4:
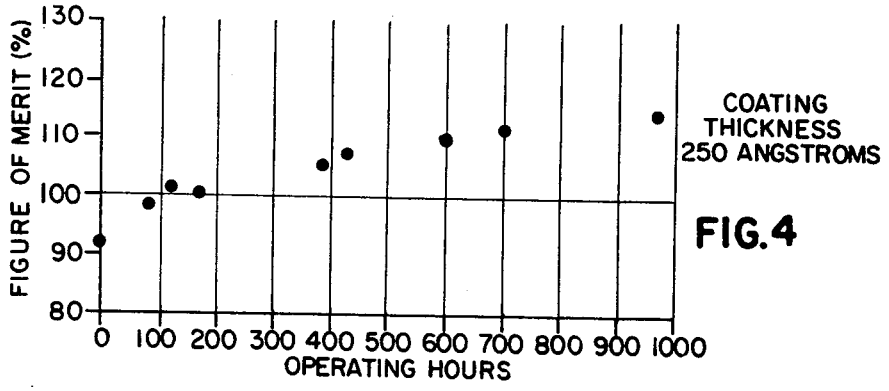
Figure 5:
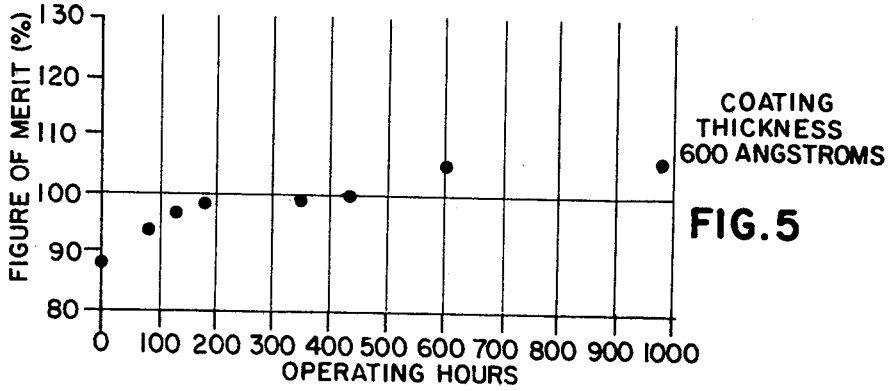

FIGS. 3, 4 and 5 depict graphs illustrating the improvement derived by employment of the invention. The graphs plot data at various thickness of yttria as tested in 4 ft. T12 lamps (40 Watt).

Figure 6:
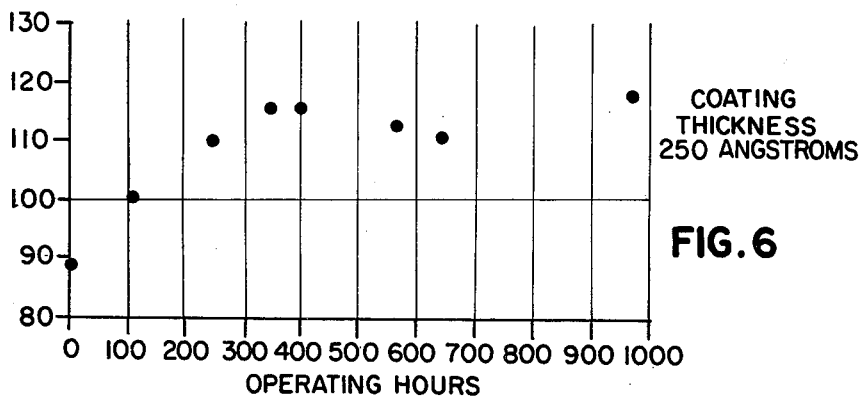
Figure 7:
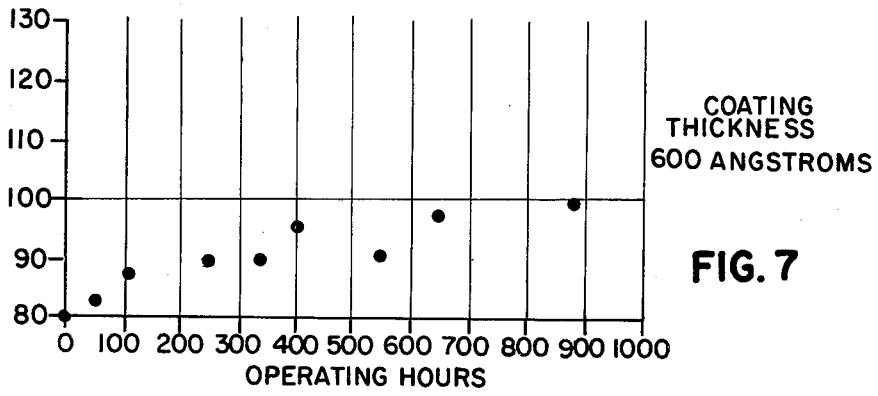

FIGS. 6 and 7 illustrate similar findings from tests conducted in 5 ft. T8 lamps (65 Watt).

The "Figure of Merit" (FOM) is the ratio of brightness between coated and uncoated phosphors and is computed as $$FOM = \frac{\text{coated brightness}}{\text{uncoated brightness}} \times 100\%.$$

The tests were accomplished by coating microscope slides with $Zn_2SiO_4$:Mn by conventional slurry technique. The slides were then baked in air for approximately three minutes at 550° C. One half of the phosphor carrying slides was then coated with yttria ($Y_2O_3$) of varying thickness; i.e., from 120 angstroms to 600 angstroms, by electron beam bombardment of an yttria target.

Various ones of the slides were then inserted and sealed into the aforementioned lamp sizes. The lamps were then operated and the brightness of the coated and uncoated phosphor was monitored with time using a brightness spotmeter.

As can be seen from the graphs of FIGS. 3–7, while the uncoated phosphor is initially brighter, as indicated by an FOM of less 100%, the coated phosphor rapidly gains in brightness as indicated by Figures of Merit greater than 100%.

In every instance the trend is definitely in favor of the coated phosphor, although the thicker the coating the longer it takes for the coated phosphor to become brighter. An exception appears in FIG. 4 which illustrates results at a thickness of 250 angstroms, the preferred thickness.

Not only are these results impressive in and of themselves, but the application of the protective yttria coating by electron beam evaporation is about two orders of magnitude faster than other methods, such as sputtering.

While there have been shown what are at present considered to be the preferred embodiments of the invention, it will be apparent to those skilled in the art that various changes and modifications can be made herein without departing from the scope of the invention as defined by the appended claims.

I claim:

1. A fluorescent lamp comprising: a tubular, hermetically sealed, glass envelope; electrodes sealed in the ends of said envelope; an arc generating and sustaining medium including mercury with said envelope; a phosphor coating on the interior surface of said envelope; and a maintenance improving coating of yttrium oxide overlying said phosphor.

2. The lamp of claim 1 wherein said yttrium oxide has a thickness of from about 120 angstroms to 600 angstroms.

3. The lamp of claim 2 wherein said phosphor is manganese activated zinc orthosilicate.

4. The lamp of claim 3 wherein said yttrium oxide has a purity of 99.99%.

5. The method of making a fluorescent lamp having improved maintenance which comprises the steps of: coating a tubular glass envelope with a phosphor; and applying over said phosphor a film of yttrium oxide.

6. The method of claim 5 wherein said film is deposited by electron beam vaporization of an yttrium oxide target and subsequent deposition of the vapor so generated upon said phosphor.

7. The method of claim 6 wherein said film is deposited to a thickness of from about 120 angstroms to about 600 angstroms.

8. The method of claim 7 wherein said yttrium oxide target has a purity of about 99.99%.

* * * * *